US005085121A

United States Patent [19]

Richardson

[11] Patent Number: 5,085,121

[45] Date of Patent: Feb. 4, 1992

[54] BRAIDED PRODUCT AND METHOD AND APPARATUS FOR PRODUCING SAME

[76] Inventor: Donald Richardson, 14 East Road, Atkinson, N.H. 03811

[21] Appl. No.: 478,088

[22] Filed: Feb. 9, 1990

[51] Int. Cl.[5] ..... D04C 3/00

[52] U.S. Cl. ..... 87/29; 87/37; 87/51

[58] Field of Search ..... 87/6, 28, 29, 30, 33, 87/37, 38, 50, 51

[56] References Cited

U.S. PATENT DOCUMENTS 2,041,950 5/1936 Pierce .
2,211,478 8/1940 Pierce .
2,238,058 4/1941 Johnson et al. .
3,463,197 8/1969 Slade .
3,481,368 12/1969 Vansickle et al. .
3,783,736 1/1974 Richardson .
3,817,147 6/1974 Richardson .
4,034,642 7/1977 Iannucci et al. .
4,420,018 12/1983 Brown, Jr. .
4,567,917 2/1986 Millard .

FOREIGN PATENT DOCUMENTS 9612 4/1880 Fed. Rep. of Germany ..... 87/51

*Primary Examiner*—Joseph J. Hail, III
*Attorney, Agent, or Firm*—Synnestvedt & Lechner

[57] ABSTRACT

A braided reinforcement for tubular conduits such as hose, and a method and apparatus for producing such reinforcement are disclosed. The reinforcement is characterized by a three over, three under braid pattern. The apparatus comprises as Maypole type braider wherein each driver of the braider includes six pockets to accommodate carrier spindles, and the number of carriers is three times the number of drivers. The invention provides an improved braided product which can be produced at lower cost with increased output.

7 Claims, 9 Drawing Sheets

FIG. 3
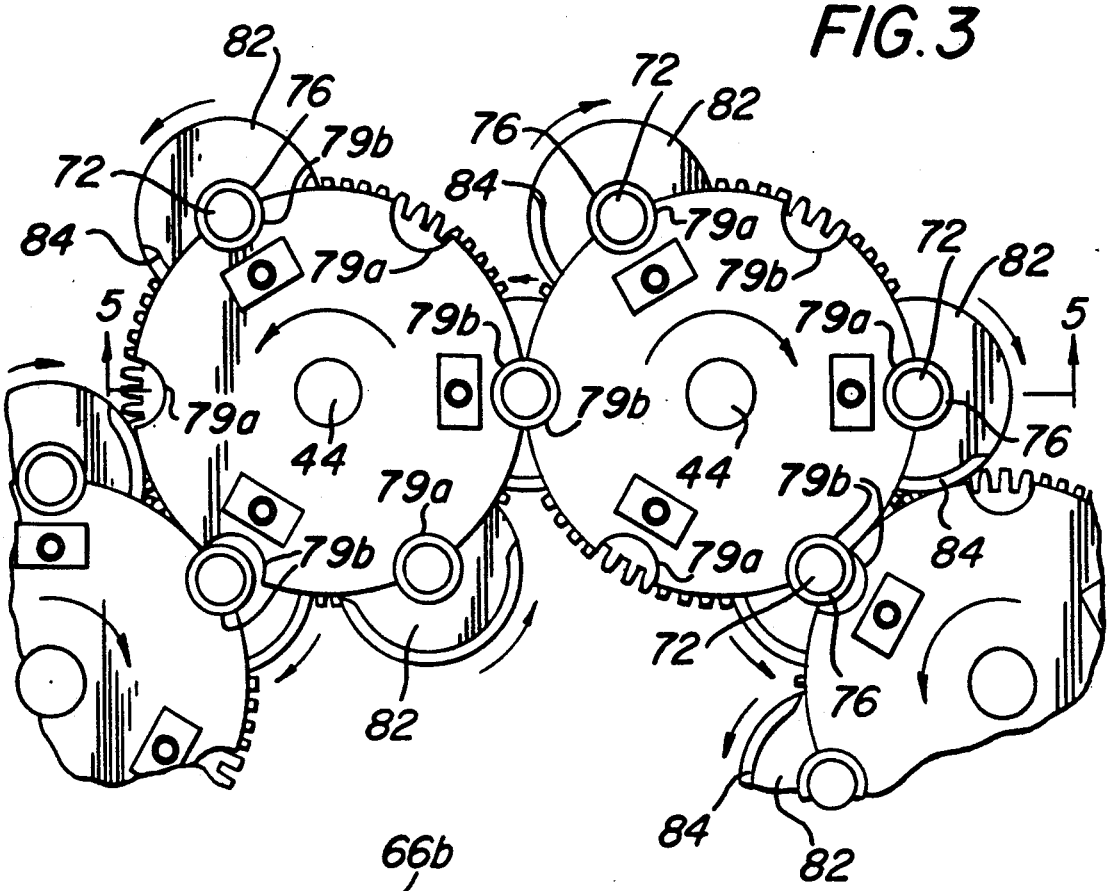
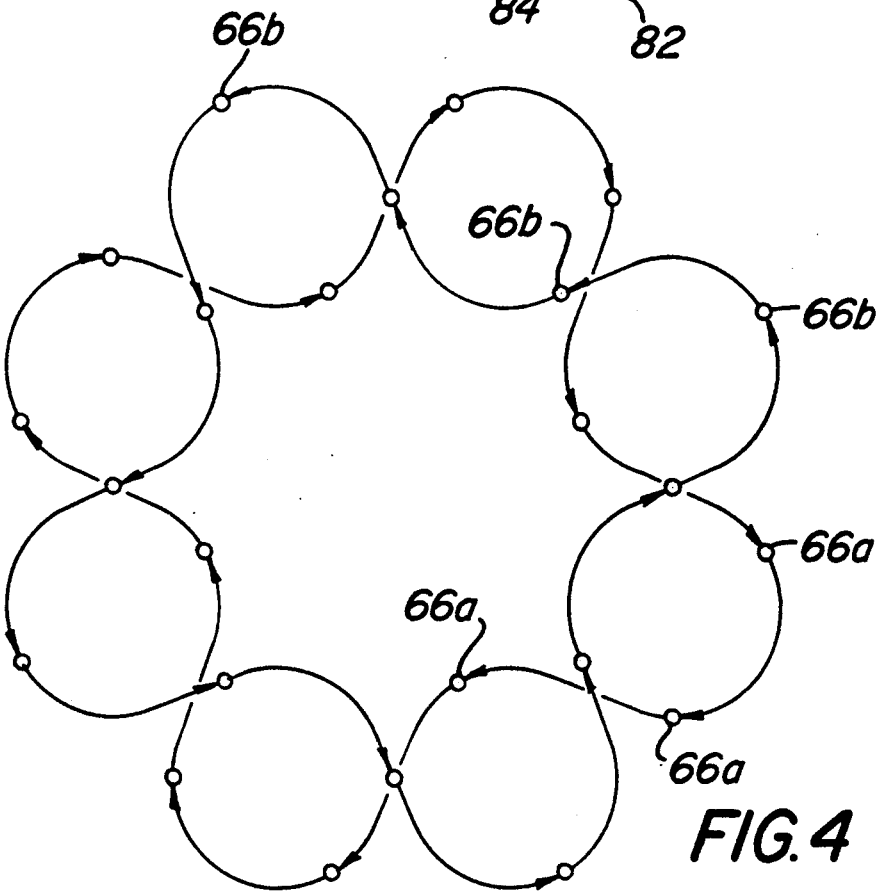
FIG. 4

FIG. 6
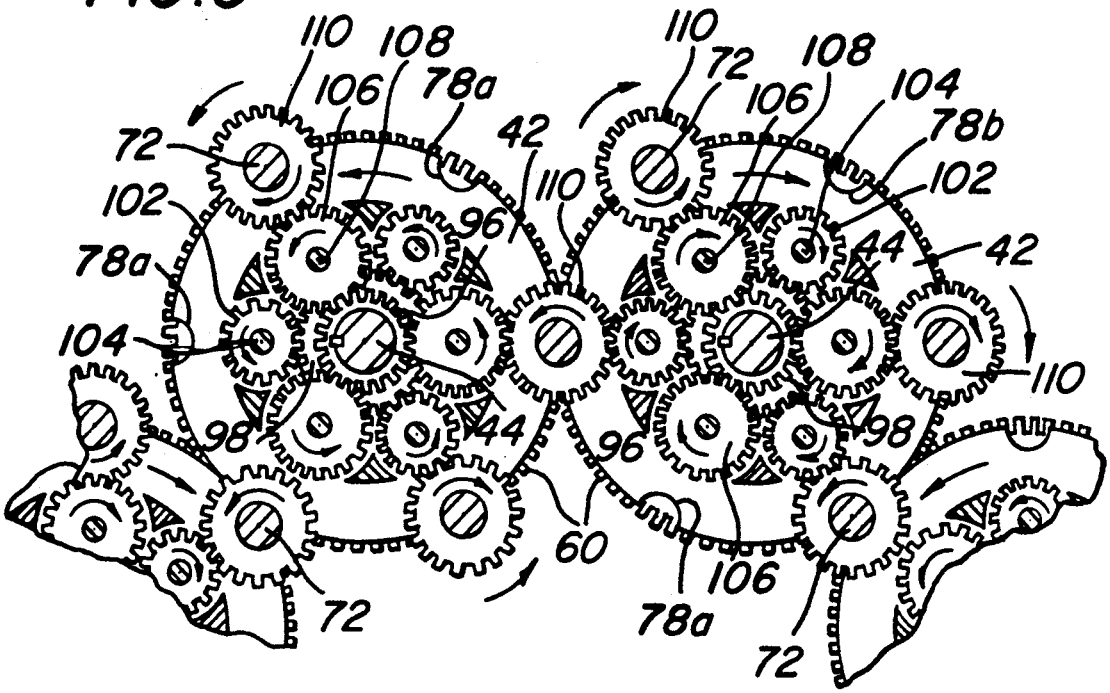
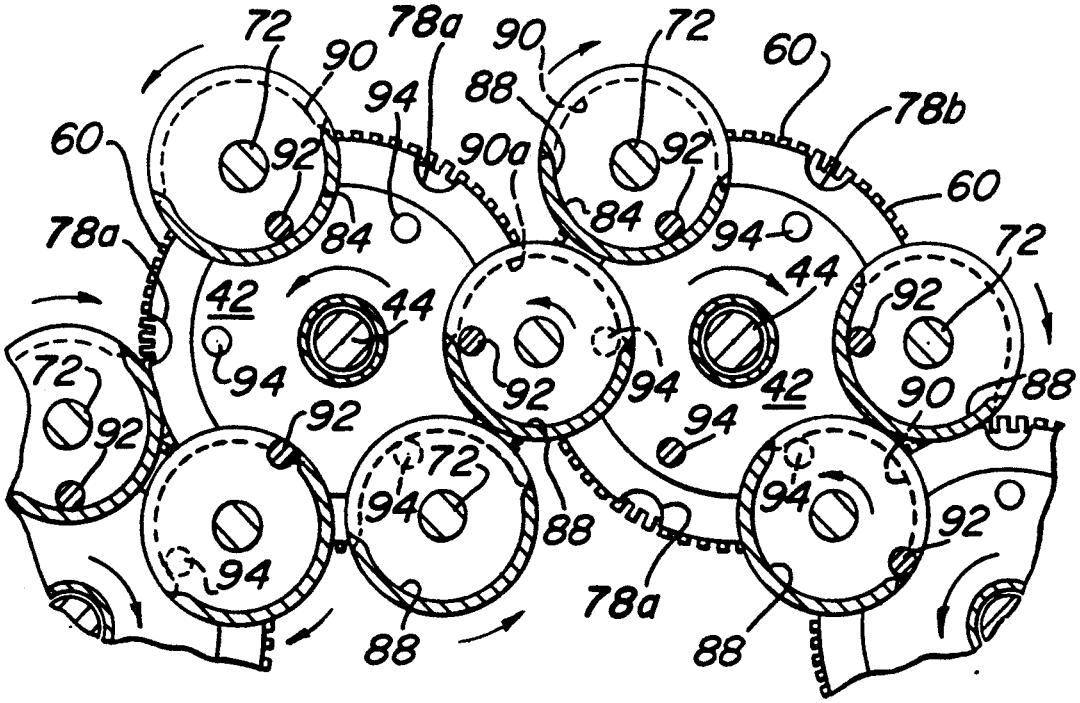
FIG. 7

BRAIDED PRODUCT AND METHOD AND APPARATUS FOR PRODUCING SAME

BACKGROUND OF THE INVENTION

1. Field of the Invention

The present invention relates generally to braided structures and to methods and apparatus for producing braided products or braided reinforcement.

More specifically, the invention is directed to an improved braided reinforcement for tubular conduits such as hose characterized by a three over, three under braid pattern. The invention further is directed to a method and apparatus for producing a three over, three under braid structure utilizing a Maypole type braider.

2. Description of the Prior Art

Braided structures have long been used to provide a combination of strength and flexibility to products such as rope and cable formed of yarn or wires as well as to flexible tubular structures in the form of reinforcement, for example hose for high pressure service covered with a braided yarn or wire reinforcement.

The conventional form of braided reinforcement for flexible conduits such as hose employs a "two over, two under" braid configuration. This has been the standard braid pattern for tubular braid structures and virtually all apparatus for forming such structures has been built to produce a two over, two under braid. Efforts to increase the performance of conventional two over, two under reinforcement have focused on the use of stronger materials, increased utilization of the available strand space, the twisting of the strands, and pressurized treatment of the braid structure prior to use. However, all of these efforts have been made in the context of a conventional two over, two under braid pattern.

The conventional braided reinforced hose comprises a plurality of flat strands of parallel yarns or wires, the wire being typically employed for high pressure hose. Since the burst strength of reinforced hose is essentially dependent upon the amount of material in the braided reinforcement, improved hose strength could be achieved by utilization of a plurality of braided layers. Such an approach is expensive in that a second braiding operation is required, and a second braided reinforcement does not effectively serve to double the hose burst strength.

A significant departure from the conventional flat braid comprised of carefully controlled parallel wires is disclosed in the Slade U.S. Pat. No. 3,463,197, wherein a mounded strand configuration utilizing a large number of small wires was proposed. This approach provided markedly improved hose performance, particularly in terms of impulse strength and has been widely used in high pressure hose applications, particularly in the aircraft industry. U.S. Pat. No. 4,567,917 to Millard adds a further step to the mounded configuration proposed by Slade, namely the preforming of the wire and the twisting of the strands to more equally distribute the pressure loads on the strand wires.

Despite the proposed changes in configuration of the strands and the materials and number of ends comprising each strand, a constant characteristic of braided reinforced hose over the past fifty years has been the utilization of the standard two over, two under braid pattern. The reinforcing braid proposed by the present invention departs markedly from this accepted standard.

The methods employed and the apparatus utilized in producing a conventional two over, two under braid vary to some degree, but fall basically in two categories. The first is the so-called Maypole or sinuous braiding technique wherein the strand carriers are moved in an intersecting serpentine path on a braiding deck as the strands are let off under tension onto the tubular element to be reinforced which is pulled at a uniform rate in a direction perpendicular to the deck. Although early forms of Maypole braiders utilized mechanisms for driving the carriers in opposite directions around sinuous tracks mounted on the braider deck, modern Maypole braiders utilize planetary gearing and a cam track and cam follower system on the carriers and drivers to eliminate the tracks and their attendant high friction and wear problems. An example of such a modern planetary gear type Maypole braider is shown for example in my U.S. Pat. No. 3,783,736, issued Jan. 8, 1974.

In a second type of braiding technique, the strand carriers are arranged in two annular groups which are axially spaced with respect to the tube to be reinforced. The groups are rotated in opposite directions with respect to the tube and a mechanism is provided for alternately guiding the strands from the outer group of carriers over and under the carriers of the inner group. Apparatus for carrying out this second technique is known as a rotary braider, an example of which is disclosed in U.S. Pat. No. 4,034,642 issued July 12, 1977.

SUMMARY OF THE INVENTION

The present invention, in contrast to the two over, two under braid pattern, comprises a three over, three under braid pattern for hose reinforcement with anticipated improvements in hose performance, as well as in speed and economy of manufacture. The three over, three under braid pattern in view of its gentler, less tortuous path due to the fewer strand intersections should provide more uniform tension of the strand elements resulting in fewer cross-overs during braiding and permitting the use of higher tensile strength braid materials.

The invention further comprises a method and apparatus for producing a three over, three under braid pattern in a braided structure and particularly utilizing a Maypole type braider. Each driver of the braider comprises six pockets to accommodate carrier spindles and the braider may thus accommodate three carriers for each driver rather than the two utilized in conventional Maypole braiders for producing two over, two under braid. Consequently, the output of a Maypole type braider can be significantly increased when constructed in accordance with the invention to produce a three over, three under braid without increasing the rotational speed of the drivers. Furthermore, the drivers being fewer in number for the same number of carriers simplifies the braider construction. Also, the drivers are larger in diameter, permitting the use of larger axles, bearings, etc. to produce a more durable machine.

It is accordingly a first object of the present invention to provide an improved reinforcing braid for a flexible tubular conduit such as a hose, said braid being characterized by a three over, three under braid pattern.

A further object of the invention is to provide a reinforcing braid as described having improved performance in comparison with conventional braid in view of its fewer strand intersections and less tortuous strand paths.

Still another object of the invention is to provide a reinforcing braid as described which is particularly adapted to implementation with high tensile strength materials.

Another object of the invention is to provide a reinforcing braid as described which is more economical to manufacture and which can be manufactured at a faster rate than conventional braid reinforcement.

Still another object of the invention is to provide a reinforcing braid as described which is particularly adapted for manufacture utilizing Maypole type braiding equipment.

A further object of the invention is to provide a method of economically manufacturing the improved reinforcing braid as described.

Still another object of the invention is to provide a Maypole type braiding machine for producing a three over, three under braid pattern.

Another object of the invention is to provide a Maypole type braiding machine as described having a higher output than conventional braiding equipment designed for conventional braid pattern.

A still further object of the invention is to provide a Maypole braider as described which can utilize carriers of a type conventional to Maypole braiders.

Additional objects and advantages of the invention will be more readily apparent from the following detailed description of the preferred embodiments thereof when considered in conjunction with the accompanying drawings.

BRIEF DESCRIPTION OF THE DRAWINGS

FIG. 3 is an enlarged view of a portion of FIG. 2 with the drivers rotationally advanced to illustrate the transfer position of one of the carriers;

FIG. 4 is a schematic view illustrating the sinuous paths of the carriers as positioned in FIGS. 1 and 2;

FIG. 6 is a reduced sectional view taken along line 6—6 of FIG. 5;

FIG. 7 is a reduced sectional view taken along line 7—7 of FIG. 5;

DESCRIPTION OF THE PREFERRED EMBODIMENT

As mentioned above, the so-called "conventional" or "normal" braid pattern is of the "two over, two under" type wherein each braid strand passes alternately over two oppositely directed strands and under two oppositely directed strands. The two over, two under braid pattern has been universally accepted in the reinforced hose field, and virtually all conventional braiding equipment manufactured for the purpose of hose reinforcement is designed to produce a two over, two under braid.

Figure 10:
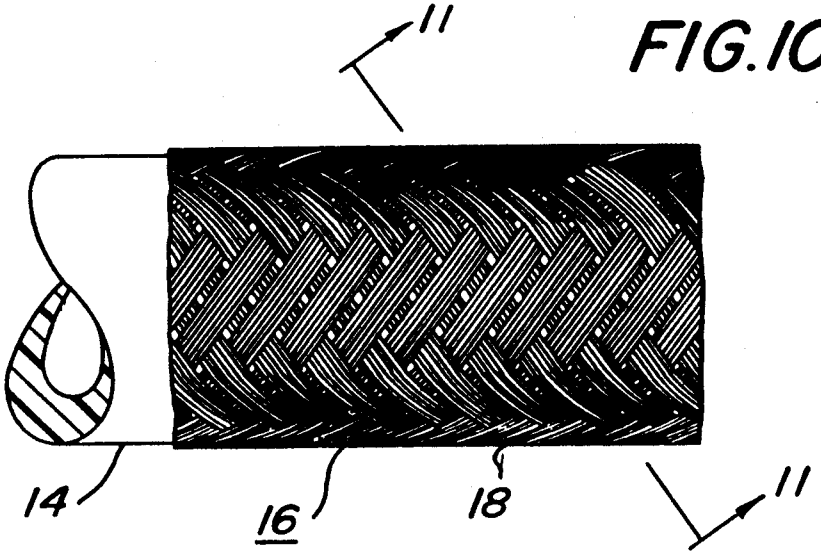
FIG. 10 is a side view partly in section showing a hose reinforced with a braid in accordance with the invention.
Figure 11:
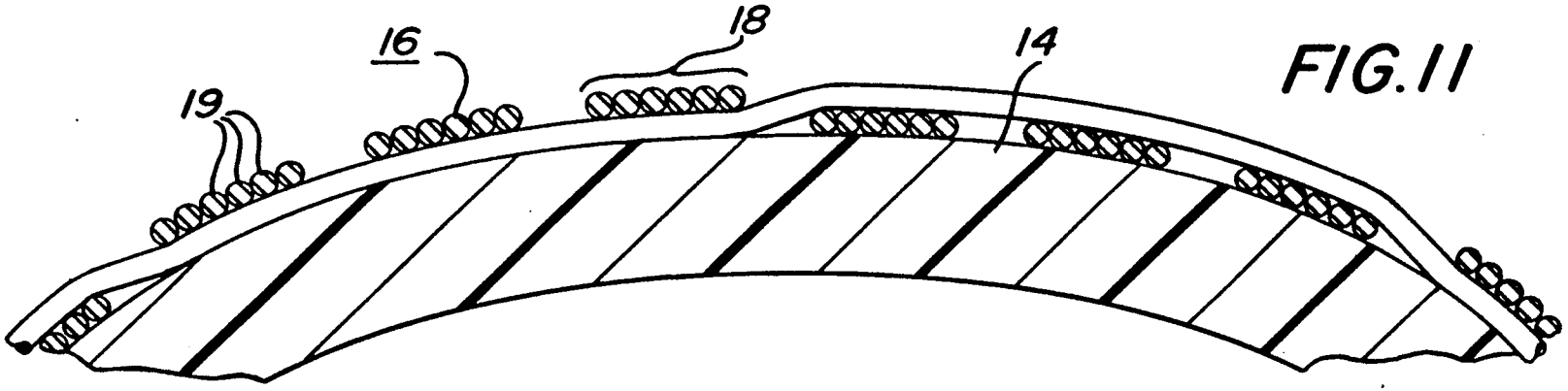
FIG. 11 is an enlarged sectional view taken along line 11—11 of FIG. 10.

In accordance with the present invention, a reinforcing braid is provided for a tubular conduit such as a hose which comprises a "three over, three under" braid pattern. In such a braid pattern, each strand passes alternately over three oppositely wound braid strands and then under the following three oppositely wound strands. A three over three under braid structure in accordance with the invention is shown in FIGS. 10 and 11 wherein a hose 14 is reinforced by an overlying three over, three under braid structure 16 comprised of a plurality of braided strands 18, each of which is formed of six parallel elements 19 forming a substantially flat braid structure. These elements in the illustrated embodiment comprise wires, although various types of yarns could also be employed. The braid strands are helically wound on the hose at the conventional braid angle of 52° 42′ which has been long established as the optimal braid angle for hose reinforcement.

One significant advantage of the three over, three under braid pattern is the substantially decreased number of strand intersections at which a strand transitions from an overlying to an underlying relation and vice versa. As discussed above, such intersections are a primary cause of uneven wire tension within a strand due to the unequal length which the inner and outer wires of a strand are forced to take during their helical passage around the tube. Since a three over, three under braid pattern reduces the number of such intersections by one-third, it can be appreciated that the adverse effect on the equality of wire tensioning within a strand will be diminished appreciably, resulting in a more even distribution of pressure stresses across the wires in a strand as well as the minimizing of the tendency of the strand wires to cross over during braiding and thereby cause weak points in the reinforcing braid.

It is further expected that the less tortuous path provided by the three over, three under braid pattern will permit the utilization of higher tensile strength strand ends with less dependency on the resilience of the strand materials to even out the stress distribution among the strand ends. For example, the utilization of fibers such as Kevlar with extremely high tensile strength but relatively low elasticity would be better suited for a three over, three under braid construction than for a conventional two over, two under braid.

In view of the advantages of the invention as described, it is expected that the three over, three under braid pattern will become the preferred format for obtaining further hose performance gains when employed in conjunction with recent hose developments such as those disclosed in the patents to Slade and Millard referenced above.

As described below, there are significant economic advantages in the manufacture of a three over, three under braid, particularly when utilizing a Maypole type braider in accordance with the method and apparatus of the invention.

Figure 1:
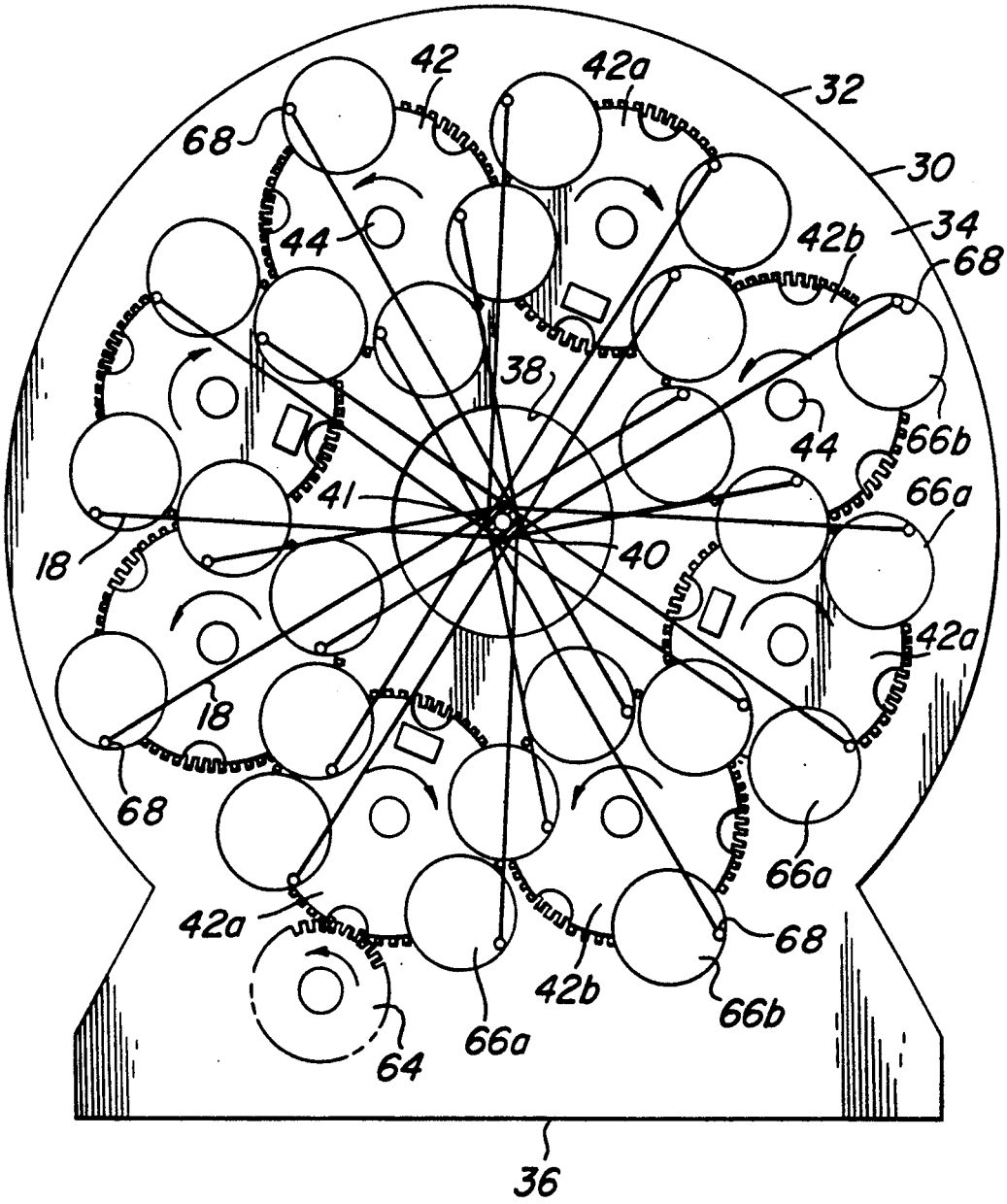
FIG. 1 is a front elevational view of a horizontal Maypole braider in accordance with the present invention.

Referring to FIG. 1 of the drawings, a horizontal Maypole braiding machine generally designated 30 is illustrated which in many respects is similar to the braiding machine described in my above referenced U.S. Pat. No. 3,783,736, which is hereby incorporated by reference. The machine 30 includes a braiding head 32 comprising a vertically extending base plate 34 supported at its lower end 36 on a floor or other suitable foundation. A central hole 38 in the base plate 34 permits passage of a tubular hose 40 to be reinforced, which hose 40 is advanced toward the viewer in FIG. 1 by a conventional haul-off apparatus (not shown) at a constant predetermined rate. The axial center line 41 of the braiding head along which the hose travels extends perpendicularly to the base plate 34 and appears as a point in FIG. 1, which is known as the braiding point.

A plurality of drivers 42 are rotatably disposed in a circular array on the base plate 34., being journaled on axles 44 fixedly mounted to the base plate. Alternate ones of the drivers 42, designated 42*a* rotate in a clockwise direction as viewed in FIG. 1 while the intermediate drivers 42*b* rotate in a counterclockwise direction.

Figure 5:
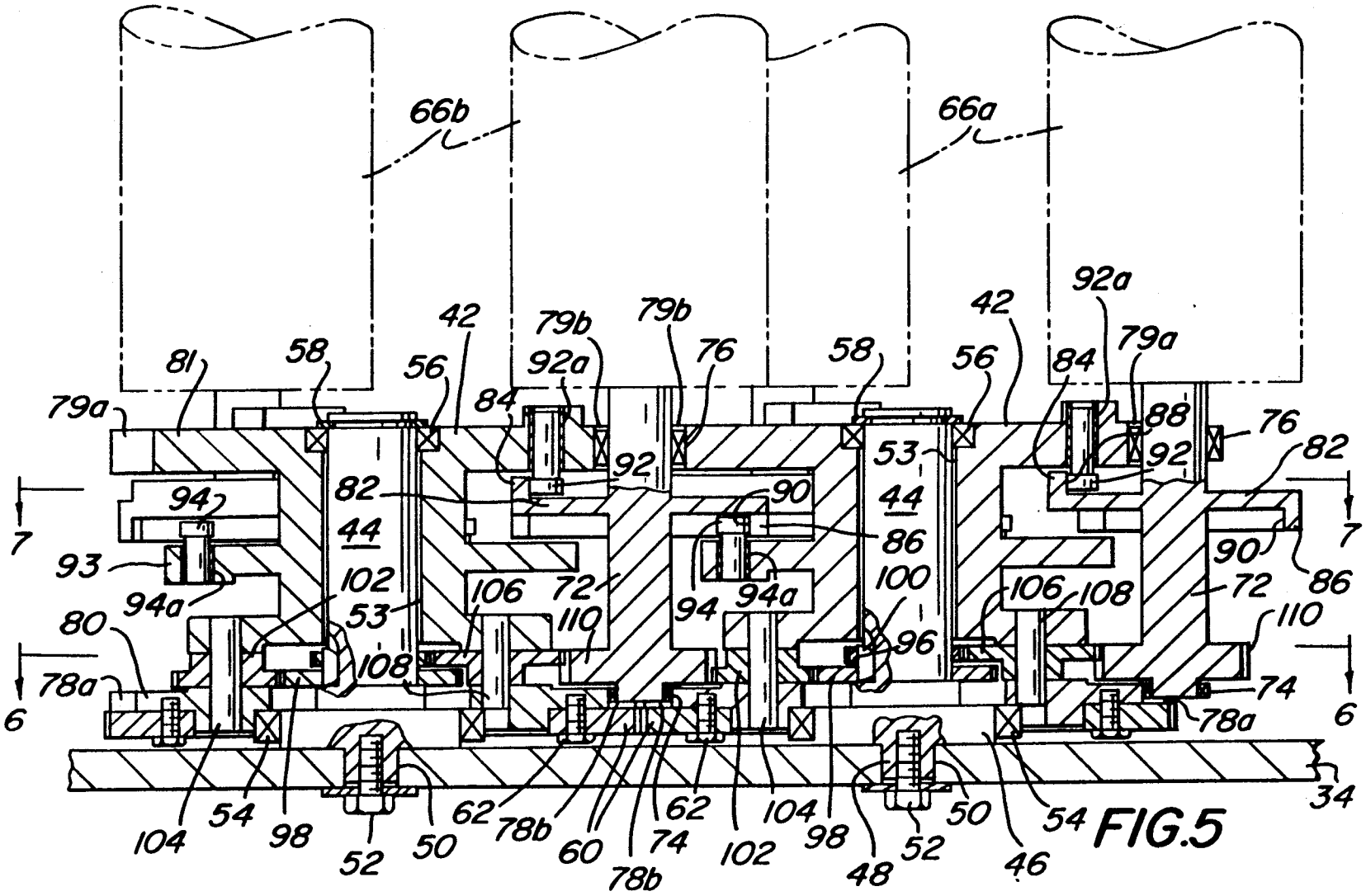
FIG. 5 is an enlarged sectional view taken along line 5—5 of FIG. 3 with the outer ends of the carriers being shown schematically in broken lines.

As shown in FIG. 5, the axles 44 include flange portions 46 which abut the base plate 34, and reduced end portions 48 which extend into bores 50 in the base plate 34. The axles 44 are secured to the base plate by screws 52 extending from the back side of the base plate into threaded engagement with axial bores in the axles.

The drivers 42 include central bores 53 to receive the axles 44 and are journaled on the axles by means of inner bearings 54 cooperating with the flange portion 46 thereof and outer bearings 56 near the outer ends of the axles. The drivers are held axially in position on the axles 44 by snap rings 58 disposed in grooves in the axles 44, the snap rings acting on the bearings 56.

The rotation of the drivers 42 is effected by ring gears 60 mounted adjacent the inner ends thereof by screws 62. Each ring gear 60 of a given driver 42 meshes with the ring gear of each adjacent driver and, since the ring gears of each driver are identical, the drivers all rotate at the same speed and in alternately opposite directions. This arrangement necessitates an even number of drivers and in the illustrated embodiment, eight drivers are shown. The entire array of drivers is driven in rotation by means of a gear 64 (FIG. 1) which is driven by the braiding machine drive motor (not shown) at a constant ratio to the haul-off apparatus.

As shown in FIG. 1, a plurality of carriers 66 are supported and driven in sinuous paths by the drivers 42, half of the carriers designated 66*a* being driven and rotated in a clockwise direction, and the other half designated 66*b* being driven and rotated in a counterclockwise direction as schematically illustrated in FIG. 4. Each carrier 66 contains a spool or bobbin of wire or yarn usually wound in strands containing a plurality of elements or ends, and in the present instance each strand 18 comprises six wires wound in flat parallel alignment. As schematically shown in FIG. 1, a strand 18 is let off from a strand pay-off point 68 on each carrier and is braided onto the hose or tube 40 by the sinuous path of the carriers illustrated in FIG. 4 in conjunction with the axial movement of the hose 40 maintained by the haul-off mechanism. The structure of the carriers 66 is substantially conventional and the details of the mechanism for regulating strand tension are not shown in the present application. A carrier suitable for use with the invention is a variation of that shown for example in my U.S. Pat. No. 3,817,147, issued June 18, 1974.

Figure 2:
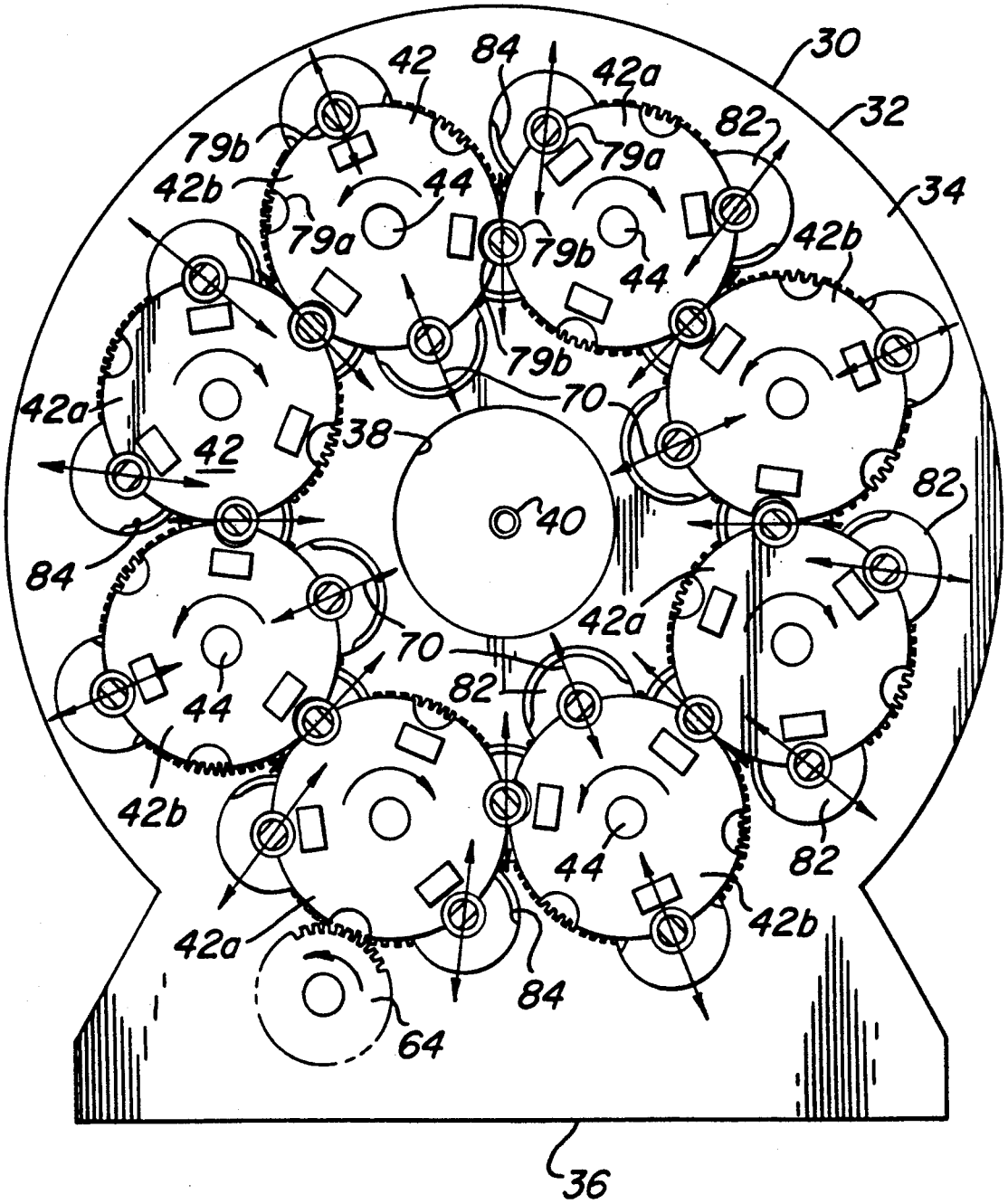
FIG. 2 is a sectional view similar to FIG. 1, but taken through the carrier spindles to show in part the mechanism by which the carriers are passed in sinuous paths around the drivers.

The drivers 42*a* and 42*b* serve not only to transport the carriers in the intersecting sinuous paths shown in FIG. 4, but additionally serve the important function of rotating the carriers in their direction of travel with respect to the hose 40 such that each carrier makes one revolution for each 360° circuit about the braiding head. In carrying out this function, the drivers maintain as shown in FIG. 2 a substantially constant relationship of the axis 70 of each carrier with respect to the hose. Planetary gearing is preferably utilized to provide the requisite rotation of the carriers.

The manner in which the carriers are held, transferred and rotated by the drivers is quite similar to that described in my earlier U.S. Pat. No. 3,783,736 with the important difference that there are three carriers for every driver in the present invention, whereas in that disclosed in my earlier patent, there are two carriers for each driver. While the present arrangement has distinct advantages in terms of productivity and simplicity of the machine design, significant structural differences are necessary in order to accommodate the larger ratio of carriers to drivers. Specifically, the present invention comprises the provision of six carrier-accommodating pockets on each driver, each driver pocket having associated therewith planetary gearing appropriate to drive the carrier at the appropriate rate and direction of rotation as well as means for holding and for transferring the carriers between adjacent drivers.

Referring to FIG. 5, each carrier 66 includes a carrier spindle 72 having spaced bearing assemblies 74 and 76 thereon adapted for cooperative engagement with inner and outer pockets 78 and 79 disposed respectively at equally spaced intervals on inner and outer circular plates 80 and 81 of the drivers 42. As seen most readily in FIGS. 2, 3 and 5, each driver includes six sets of upper and lower pockets spaced at 60° intervals about its circumference. Alternate ones of the pocket sets designated 78*a* and 79*a* are adapted for use by carriers traveling in a clockwise direction, while the other pocket sets 78*b* and 79*b* are adapted for use by the carriers 66*b* traveling in a counterclockwise direction as viewed for example in FIGS. 1–4. The pocket sets are located on the drivers such that the pockets of adjacent drivers will come into cooperative alignment at periodic angular rotational positions of the drivers as shown for example in FIGS. 3 and 5.

The carrier spindles 72 are held in the spaced pockets 78 and 79 during their travel on each driver by means of cam tracks on the carrier spindles and cam followers in the form of rollers on the drivers interacting therewith. As shown in FIGS. 5 and 7, each carrier spindle 72 includes a radially extending annular track support plate 82 each of which includes upper and lower peripheral flanges 84 and 86. The flanges 84 and 86 extend substantially 180° around the periphery of the plates 82 and are substantially diametrically opposed in their angular extent. As shown in FIG. 2, the flanges are arranged so that each flange is bisected by the carrier axis 70.

The inner faces of the flanges 84 and 86 define semicircular tracks 88 and 90 respectively which cooperate respectively with rollers 92 and 94 on the drivers 42. There is a roller radially aligned with each driver pocket with half of the rollers being positioned to cooperate with the tracks 88 and the other half being positioned to cooperate with the tracks 90. As shown most clearly in FIGS. 5 and 7, rollers 92 extend inwardly from arms 93 of the drivers 42 adjacent every other pocket set for engagement with tracks 88, and the rollers 94 extend outwardly from the arms 93 at pockets intermediate those equipped with the rollers 92 for cooperation with the tracks 90.

In FIG. 5, the rollers 92 are disposed adjacent the pocket sets 78*a* and 79*a* in the right hand driver illustrated, whereas in the left hand driver the roller 92 is disposed adjacent the pocket sets 78*b* and 79*b*. Thus adjoining drivers have the rollers 92 and the rollers 94 alternately disposed with respect to the driver pocket sets 78*a*, 79*a* and 78*b* and 79*b* such that as the pocket sets become aligned during driver rotation, a roller 92 will always become aligned with a roller 94. This arrangement in conjunction with the rotation of the carrier spindles derived from the planetary gearing to be described below, permits the passing off of the carriers from one driver to the next to carry out the sinuous carrier paths schematically shown in FIG. 4. The rollers 92 and 94 are journaled in bearings 92*a* and 94*a* respectively in the drivers, these bearings along with the other bearing assemblies being shown only schematically in the view of FIG. 5.

The planetary gearing mechanism for rotating the carriers as they travel with the drivers is illustrated in FIGS. 5, 6 and 6*a–e*. Fixedly mounted to each axle 44 near the inner end thereof are a pair of inner and outer sun gears 96 and 98 which are attached to the axle by means of key 100 engaged in a slot therein. The inner sun gear 98 is of substantially larger pitch diameter than the outer sun gear 96 although the circular pitch of the gear teeth are the same. Three inner planetary gears 102 rotatably disposed on shafts 104 on each driver are engaged with the sun gear 98 and are disposed, in the case of the drivers rotating clockwise as viewed in the drawings in radial alignment with the pocket sets 78*b* and 79*b*, and in the case of the drivers rotating counterclockwise, in alignment with the pocket sets 78*a* and 79*a*. Each driver further includes three outer planetary gears 106 rotatably mounted on shafts 108 and intermeshed with the sun gear 96. The outer planetary gears 106 are disposed in radial alignment with alternative pocket sets 78*a* and 79*a* in the case of the drivers rotating in a clockwise direction, and with pocket sets 78*b* and 79*b* in the case of drivers rotating in a counterclockwise direction as is evident from FIG. 6. The sum of the pitch diameters of the sun gear 98 and one of the planetary gears 102 is the same as the sum of the pitch diameters of the sun gear 96 and one of the planetary gears 106.

The carrier spindles 72 each include a gear 110 extending radially therefrom which is of sufficient axial breadth to intermesh with either the planetary gears 102 and 106, the circular pitch of the gear teeth of the sun gears 96 and 98, planetary gears 102 and 106 and the spindle gears 110 being the same. Inasmuch as the planetary gears are disposed with respect to the driver pockets such that a carrier spindle within a pocket has its gear face 110 engaged with either a planetary gear 98 or 106, each carrier spindle is always engaged with at least one planetary gear and, at the point of transfer of the carrier from one driver to another, when the pockets of adjacent drivers are aligned, the spindle gear face is enmeshed with planetary gears of two drivers.

The function of the planetary gear system is to completely isolate carrier rotation from driver rotation. Drivers 42*a* and 42*b* serve to space and propel the carrier spindles along their sinuous paths. The planetary gears maintain the carrier spindles in a prescribed rotation and in doing so cancel out rotational influences by driver rotation. Each carrier spindle is always under the direct influence of one or more planetary gears. The desired control is to rotate each carrier spindle axis 360° during one orbit around the deck. The planetary gearing effects the carrier spindle rotation continuously, even during spindle transfer between drivers and hence eliminates any angular accelerations of the carriers.

Planetary gears of this type are readily described mathematically. One full rotation of one driver propels a carrier spindle 90° or one quarter of its orbit around the deck (see FIG. 9). Thus, for the 8 driver 24 carrier example illustrated, the planetary gear train value is:

$$\frac{\text{Spindle axis rotation (in degrees)}}{\text{Driver rotation (in degrees)}} = \frac{90^\circ}{360^\circ} \text{ or } \frac{1}{4}$$

This ratio establishes that for every 4° of driver rotation, the spindle axis rotates 1° in its direction of travel. To achieve this, the planetary gear system is sized to subtract out a portion of spindle rotation while the spindle is on the outer periphery of the driver. The gear system adds spindle rotation while the spindle is traveling on the inner periphery of the driver. In this manner the desired control of spindle rotation is maintained throughout the carrier orbit of the deck.

Specifically, for the carriers traveling around the outer periphery of the drivers considered with respect to the hose, the spindle gear face 110 will always be intermeshed with the larger planetary gears 106 as can be seen in FIG. 6. Accordingly, in the case of drivers 42*a* rotating in a clockwise direction, the larger planetary gears 106 are disposed in radial alignment with the pocket sets 78*a* and 80*a*. With regard to the drivers 42*b* rotating in a counterclockwise direction, the larger planetary gears are disposed in alignment with the driver pocket sets 78*b* and 80*b*.

Conversely, the carriers traveling along the inner periphery of the drivers as viewed with respect to the hose are engaged with the smaller planetary gears 102. In the case of the drivers 42*a* rotating in a clockwise direction, the smaller planetary gears are aligned with the pockets 80*b*, while in the case of the drivers 42*b* rotating in a counterclockwise direction, the smaller planetary gears 102 are aligned with the pocket sets 78*a* and 80*a*.

Since the planetary gears as illustrated in FIG. 6 each rotate in the same direction as the driver in which they are mounted, the carrier will, with respect to the driver on which it is mounted, rotate in the opposite direction. However, with respect to the hose, each carrier will continue to rotate about the hose in the direction in which its sinuous path is taking it, even though it may be rotating in the opposite direction with respect to the carrier on which it is being carried.

For example, in FIG. 6 the carrier at the eleven o'clock position of the left hand fully shown driver is rotating clockwise with respect to the driver, since the driver is rotating counterclockwise as is its planetary gears. However, the carrier with respect to the hose being braided is rotating counterclockwise. In the drawing views, and particularly FIG. 6, the movement of each carrier with respect to the hose or braiding point is designated by the arrow outside of the carrier, whereas the rotation of each carrier with respect to the driver on which it is being moved is shown within the outline of the carrier.

The need for larger planetary gears engaging the carriers as they pass around the outer periphery of the drivers in contrast to smaller planetary gearing engaging the drivers passing around the inner periphery of the drivers can be understood when it is considered that the carriers traveling around the outer periphery are rotating in the same direction as the drivers while those on the inside are rotating in a contrary direction. Accordingly, a faster speed of rotation with respect to the drivers is required of the carriers traversing the inner path whereas the carriers traversing the outer path are actually being slowed down. A more detailed description of this planetary gearing is set forth in my abovementioned U.S. Pat. No. 3,783,736.

Figure 6A:
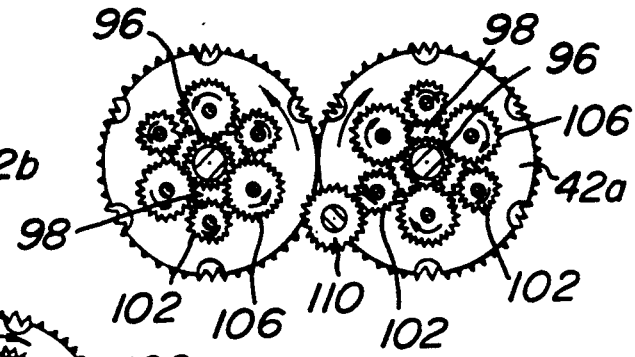
FIGS. 6*a–e* are sequential reduced sectional views similar to FIG. 6 illustrating the passage of a single carrier from one driver to the succeeding driver and particularly the interaction of the gearing during the transfer for maintaining the continuing rotation of the carrier.
Figure 6B:
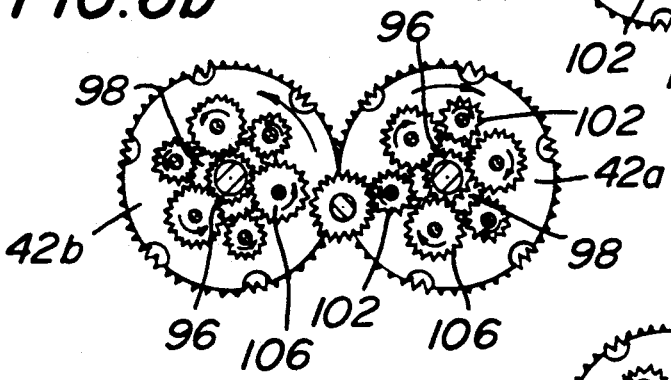
Figure 6C:
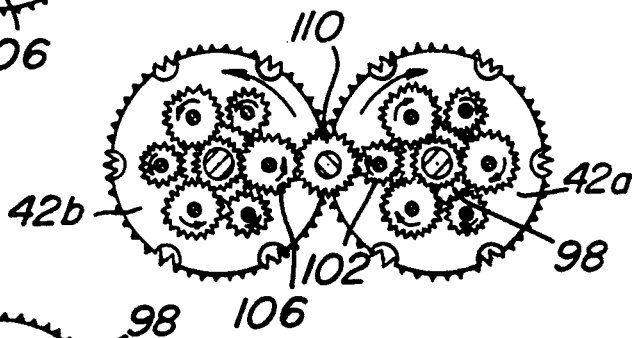
Figure 6D:
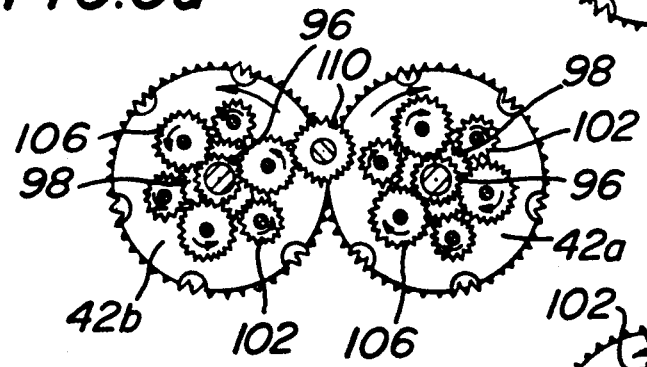
Figure 6E:
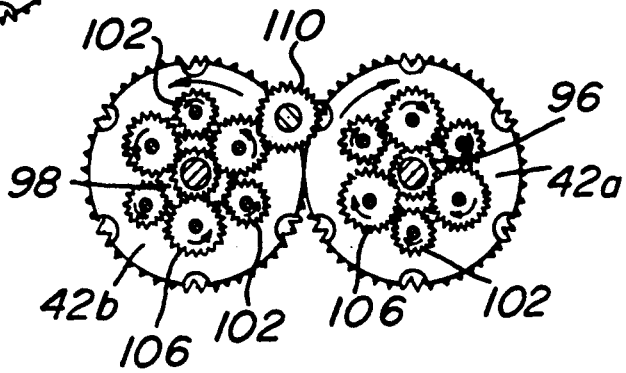
Figure 7A:
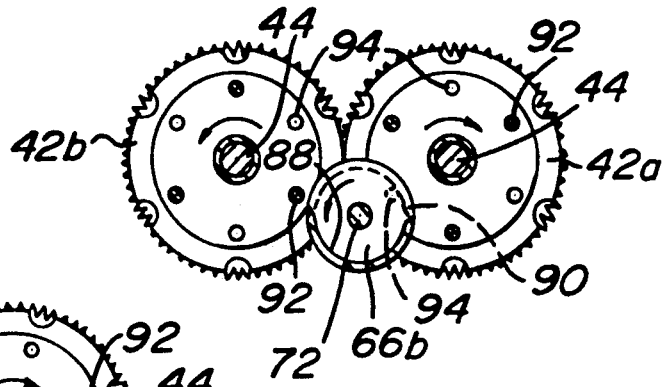
FIGS. 7*a–e* are reduced sequential sectional views similar to FIG. 7 showing the manner of operation of the mechanism for transferring a carrier from one driver to the succeeding driver.
Figure 7B:
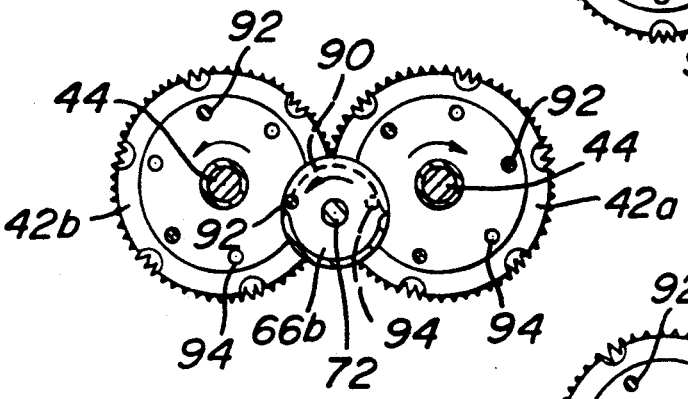

The manner in which the carrier spindles are transferred from one driver to another is shown in the sequential views of FIGS. 7*a–e*. The corresponding views of FIGS. 6*a–e* show the planetary gear engagement with the carrier gear during the transfer of the carrier. In these views, the carrier 66*b* illustrated is rotating counterclockwise with respect to the hose being braided and in the initial views of FIGS. 6*a* and 7*a* is being carried around the inner periphery of the driver 42*a* and being retained in a pocket thereof by the roller 94 in engagement with the carrier track 90.

In the views of 6*b* and 7*b*, the carrier has advanced closer to the transfer point but is still retained on the driver 42*a* by the roller 94 holding the carrier spindle in the driver pocket. As shown in FIG. 6*b*, the carrier is still being rotated by engagement with the small planetary gear 102.

Figure 7C:
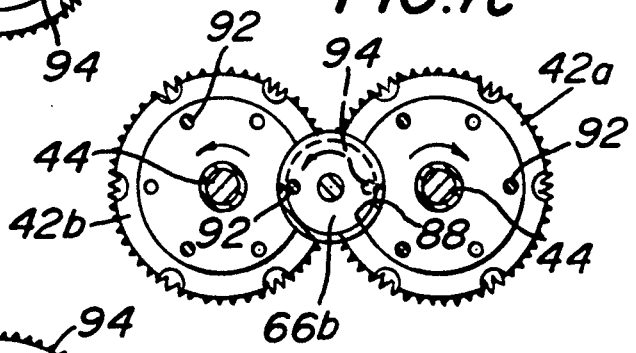

In the views of FIGS. 6*c* and 7*c*, the carrier has reached the transfer point at which the pockets of the adjacent drivers 42*a* and 42*b* are aligned with a line joining the driver axes. At this point, the roller 94 has reached one end of the track 90 and one of the rollers 92 of the driver 42*b* has moved into a position adjacent one end of the carrier track 88. At this stage, the carrier spindle is securely held in position by the aligned juxtaposed pockets of the adjacent drivers in addition to the rollers 92 and 94 cooperatively disposed with respect to the tracks 88 and 90. Also at this point, the carrier gear 110 has come into engagement with one of the large planetary gears 106 of the driver 42*b* but while remaining engaged with the small planetary gear 102 of the driver 42*a*.

The desired spindle rotation (1° for every 4° of driver rotation) persists even during transfer since the meshing planetary gears on each side are rotating at different speeds. At the transfer point shown in FIGS. 6*c* and 7*c*, the spindle gear is engaged on its left by the larger, slower rotating planetary gear 106 and on its right by the smaller, faster rotating planetary gear 102. The gear 106 provides a minus ¼ ratio drive with respect to the driver rotation, while the gear 102 provides a plus ¼ drive ratio, thus maintaining a counterclockwise spindle rotation within the confines of the driver pockets at the correct ratio of 1° for every 4° of driver rotation.

Figure 7D:
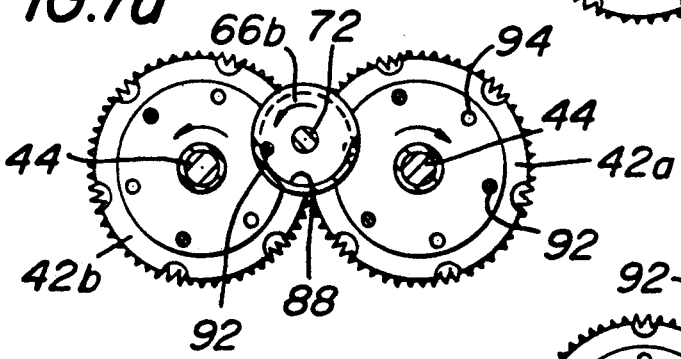

In the carrier position shown in FIGS. 6*d* and 7*d*, the carrier has left the custody of driver 42*a* since the roller 94 is no longer engaging the track 90. The roller 92 of driver 42*b* has engaged the track 88, thus rotatably securing the carrier in the pocket of driver 42*b*. As shown in FIG. 6*d*, the carrier gear 110 has become disengaged from the small planetary gear 102 of driver 42*a* and its rotation is continued by its engagement with the gear 106 of driver 42*b*.

Figure 7E:
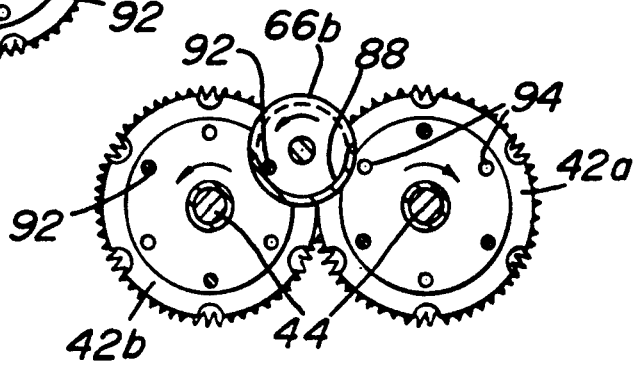

In FIGS. 6*e* and 7*e*, the carrier has moved further along its path and its disengagement from the driver 42*a* is more evident. The carrier, although rotating clockwise with respect to the driver 42*b* due to the counterclockwise rotation of the driver and its planetary gears, nonetheless is rotating counterclockwise with respect to the braiding point.

The above describe manner of exchange of the carriers by adjacent drivers is basically the same for all of the carriers, although as indicated in FIG. 4, half of the carriers are moving in a clockwise serpentine path whereas the other half are moving in a counterclockwise serpentine path. It will be noted from FIG. 4 that each carrier will pass over three carriers approaching from the opposite direction and then under three carriers, and that this three over, three under pattern is continuous.

For operation of the braiding apparatus, the carriers are loaded with spools of yarn or wire and the strands therefrom are led to the centered conduit or hose to be braided which is gripped by the haul-off apparatus. An appropriate drive ratio between the haul-off speed and the braiding head speed is established, following which the braiding operation is begun by engaging the motor drive of both the braiding head and the haul-off device. The continuous rotation of the drivers at a predetermined speed coupled with the uniform advance of the structure being braided by the haul-off device results in a three over, three under braid having a constant braid angle. Preferably, this braid angle is the conventional standard 54°, 42'. An example of a braided hose reinforced utilizing the method and apparatus as described is shown in FIGS. 10 and 11.

The present method and apparatus may also be utilized to produce other braided structures, such as braided rope or wire.

Although the rotary braider could conceivably be modified to produce a three over, three under braid, such modification would result in greatly increased machine complexity and cost, and decreased productivity. In contrast, the utilization of a Maypole braider actually simplifies the machine and reduces its cost, while significantly increasing productivity.

Figure 8:
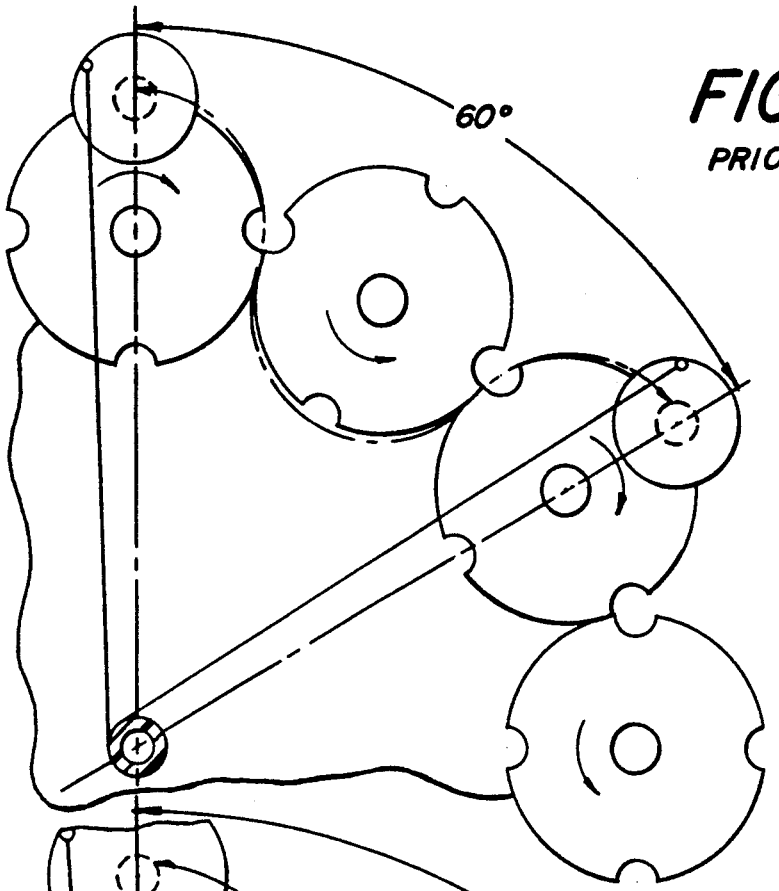
FIG.8 PRIOR ART
FIG. 8 is a schematic front elevational view of a portion of a conventional two over two Maypole braider showing the angular distance of travel of a single carrier resulting from one revolution of the drivers.
Figure 9:
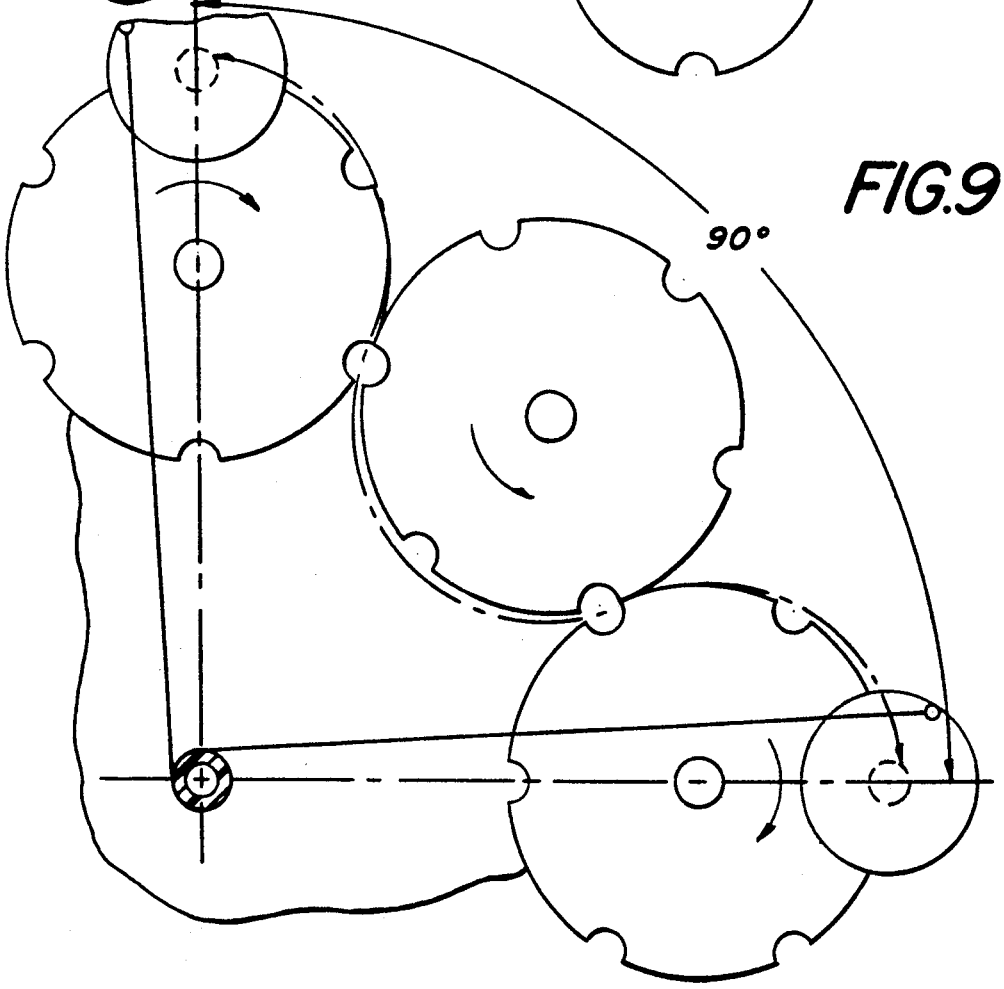
FIG. 9 is a schematic front elevational view of a three over three under Maypole braider in accordance with the present invention showing the angular distance of travel of a single carrier resulting from one revolution of the drivers.

The productivity increase available by utilization of the present invention is illustrated by the schematic views of FIGS. 8 and 9. In FIG. 8, illustrating a conventional two over, two under braider having twelve drivers and twenty four carriers with four pockets per driver, the angular distance that a carrier is advanced by one revolution of the drivers is schematically illustrated and may be seen to encompass 60°.

In contrast, with the present invention utilizing eight drivers and twenty four carriers, a single revolution of the drivers will result in a 90° angular carrier movement about the braiding point. In each instance, the carrier has essentially traveled a distance equal to the circumference of a driver, but the drivers with the present invention are larger in diameter than those of a conventional two over, two under braider since there are fewer of them with the same number of carriers. As a result, the productivity increases expected with the method and apparatus presently disclosed are significant, on the order of 33%. The actual gain in productivity will be the culmination of many factors. The anticipated gain of 33% over two over, two under decks has factored in the machine criteria based on increased driver diameter and resultant higher velocities together with centripetal accelerations and the like.

The following example comparing a two over, two under prior art braider having twenty four carriers with a braider in accordance with the invention illustrates the productivity increase available, the rotational speed of a carrier being a direct measure of productivity of the braider.

| | Prior Art | Invention |
|---|---|---|
| No. of Drivers | 12 | 8 |
| No. of Carriers | 24 | 24 |
| Braid Pattern | 2/2 | 3/3 |
| Driver rev/min. | 225 | 225 |
| Carrier rev/min. | 37.5 | 56 |

In addition to the substantial improvement in productivity provided by the present apparatus, there are additional economic advantages flowing from the fact that the present machine, having proportionately fewer drivers, has fewer parts and hence is less complicated and less costly to manufacture than conventional braiding equipment. Furthermore, the present apparatus is subject to less dynamic imbalance than conventional equipment. Whereas a two over, two under braider will subject the drivers to carrier loads ranging from one to three carriers, the present three over, three under braider will result in a driver load of either two or three carriers.

Since the drivers in accordance with the invention will be larger than the conventional drivers for a given supply spool capacity, the driver support structure including the axles, bearings, etc., can be larger and hence stronger.

The conversion of a Maypole type braider to the present three over, three under method has the further advantages, compared to conventional two over, two under braiding, of reducing the frequency of spindle transfers, and decreasing track to roller velocities (at the same driver RPM). In addition, the number of carrier payouts is decreased, the braid tensions are reduced and vibration is decreased.

Although the preferred braiding apparatus as described incorporates a planetary gearing system and cam track arrangement for advancing, rotating and transferring the carriers, it will be apparent that apparatus in accordance with the invention can be utilized with other forms of carrier drives such as the older style tracked deck type braider. The planetary gearing system described, is however, ideally suited for production of a three over, three under braid in view of the many proven advantages of such a braider as described above and as referenced in my U.S. Pat. No. 3,783,736.

Although the present apparatus has been illustrated with eight drivers and twenty four carriers, other configurations are possible which maintain the same three to one carrier to driver ratio; for example, six drivers with eighteen carriers, ten drivers with thirty carriers, twelve drivers with thirty-six carriers and sixteen drivers with forty-eight carriers.

While the preferred form of braid shown is characterized by flat strands having equal numbers of elements, the present braid is well suited for "mounded" braid strands such as shown in the Slade U.S. Pat. No. 3,463,197, or for unbalanced type braids such as shown in Van Sickle U.S. Pat. No. 3,481,368 wherein strands in one direction have five elements whereas strands in the other direction have six elements.

Manifestly, changes in details of construction can be effected by those skilled in the art without departing from the invention.

I claim:

1. A Maypole braiding machine for producing a tubular braided structure having a uniform braid pattern comprising, a base plate, an even number of drivers rotatably mounted on said base plate in a circle, the center of said circle defining a braid point, means for rotating said drivers at the same speed with adjacent drivers rotating in opposite directions, a plurality of carriers supported and driven by said drivers, the number of said carriers being three times the number of said drivers, said drivers directing half of said carriers in one direction along an endless sinuous path about said braid point, and the other half of said carriers in the opposite direction along an endless intersecting sinuous path around said braid point such that each carrier passes alternately outside of three carriers and inside of three carriers traveling in the opposite direction so as to provide a tubular braided structure having a three over and three under braiding pattern around said braid point during operation.

2. The invention as claimed in claim 1, wherein each said driver comprises six pockets spaced at 60° intervals for receiving said carriers.

3. The invention as claimed in claim 1, including means for retaining said carriers on said drivers and for transferring said carriers between said drivers.

4. The invention as claimed in claim 3, wherein said means for retaining and transferring said carriers comprises a roller disposed adjacent each driver pocket, and tracks on each carrier disposed for selective cooperative engagement with said rollers.

5. The invention as claimed in claim 1, comprising means for continuously rotating each carrier as it is driven by said drivers so that each carrier rotates 360° around the carrier spindle axis during one orbit around the base plate.

6. The invention as claimed in claim 5, wherein said means for rotating said carriers comprises a system of planetary gearing.

7. The invention as claimed in claim 6 wherein there are eight drivers.

* * * * *